US006383074B1

(12) United States Patent
Boggs

(10) Patent No.: US 6,383,074 B1
(45) Date of Patent: May 7, 2002

(54) METHODS AND APPARATUS FOR PARIMUTUEL GAMING USING SPEECH RECOGNITION

(75) Inventor: Steven B. Boggs, Westminster, MD (US)

(73) Assignee: AmTote International, Inc., Hunt Valley, MD (US)

( * ) Notice: Subject to any disclaimer, the term of this patent is extended or adjusted under 35 U.S.C. 154(b) by 0 days.

(21) Appl. No.: 09/548,413

(22) Filed: Apr. 13, 2000

Related U.S. Application Data

(60) Provisional application No. 60/129,555, filed on Apr. 16, 1999.

(51) Int. Cl.[7] ..... A63F 9/24

(52) U.S. Cl. ..... 463/25; 463/6; 463/41

(58) Field of Search ..... 463/6, 25, 28, 463/41

(56) References Cited

U.S. PATENT DOCUMENTS 4,322,612 A 3/1982 Lange
5,564,977 A 10/1996 Algie
5,573,244 A 11/1996 Mindes
5,820,459 A 10/1998 Acres et al.
5,842,921 A 12/1998 Mindes et al.
5,904,619 A 5/1999 Scagnelli et al.
6,004,211 A 12/1999 Brenner et al.

*Primary Examiner*—John Paradiso
(74) *Attorney, Agent, or Firm*—Armstrong Teasdale LLP

(57) ABSTRACT

In an exemplary embodiment, a system for parimutuel gaming includes a tote system, a gateway, and at least one voice recognition unit. Each voice recognition unit is communicatably connected to a public telephone network, and is communicatably connected to the tote system through the gateway. Each voice recognition unit is configured to receive wagers from a bettor by bettor speech utterances, to convert the bettor speech utterances into commands, to transmit the commands to the tote system through the gateway, to receive responses from the tote system to said commands, to convert the responses to audio messages, and to transmit the audio messages to the bettor. The system also includes a first high speed network communicatably connecting the tote system and the gateway; and a second high speed network communicatably connecting the gateway and each voice recognition unit.

64 Claims, 5 Drawing Sheets

METHODS AND APPARATUS FOR PARIMUTUEL GAMING USING SPEECH RECOGNITION

CROSS REFERENCE TO RELATED APPLICATIONS

This application claims the benefit of U.S. Provisional Application No. 60/129,555, filed Apr. 16, 1999.

BACKGROUND OF THE INVENTION

The present invention is generally related to gaming devices and more specifically, to a gaming device which enables parimutuel betting on events such as dog races, horse races, or jai alai games.

Parimutuel racetrack systems, known as "totalisators" or "tote systems" commonly offer the ability for a racetrack patron to open a financial account and deposit funds in the account for the purposes of placing wagers. The cost of a wager is debited from the account balance. Winning wager proceeds are credited to the account balance. Account wagers are generally, but not specifically, placed by the patron using a telephone to communicate the wager to a terminal operator. The terminal operator accesses the account housed in the tote system to place the wager on behalf of the patron.

Although the above described method provides the racing patron with an elevated level of convenience, over the years, the racing industry has seen an increase in labor costs for terminal operators while experiencing a reduction in revenue because of gaming competition. Racetrack owners would like to maintain the level of convenience for patrons while reducing the racetrack operating costs.

It would then be desirable to provide an automated telephone based account wagering device which incorporates the services of a terminal operator without requiring the presence of a terminal operator.

Known automated telephone account betting devices employ the process of prompting the patron for a wager component and waiting for the patron to respond by touching one or several keys on a touch tone telephone to signal the patrons choice. This type of automated telephone account betting device is known as a "touch tone" betting system. This type of system tends to be slow and confusing because the patron must wait for the device to direct the patron as to which wager component is being collected.

It would be desirable to improve the interface between the patron and the automated device such that, the patron may speak to the device using natural language and have the device recognize the speech utterances and take the appropriate actions. An automated speech recognition telephone betting device would improve the patron device interface by eliminating the need for touch tone telephones and more closely emulating the terminal operator. The automated speech recognition telephone betting device would further reduce operating costs at racetracks by increasing transaction rates and thereby reducing the number of telephone lines employed to collect the same number of transactions per hour as collected by touch tone devices.

BRIEF SUMMARY OF THE INVENTION

In one aspect the present invention is a wagering device which enables telephone account wagering without terminal operators. The device, in one embodiment, includes a plurality of telephone lines. Many devices may be connected to a single tote system. The automated speech recognition telephone betting device is a multi-function device which enables the patron to open the account for betting, enter a wager, review past wagers, retrieve information about the racing products being offered on the tote system, and close the account when the patron hangs up the telephone. The device is a computer system configured to manage the entire telephone conversation with the patron. For example, the device answers the telephones, greets the patrons with an audio message, prompts the patrons as to available options with another audio message, listens to patron speech utterances, converts the patrons speech utterances into commands, transmits the commands to the tote system, receives responses to the commands from the tote system, and converts the responses to audio messages for the patrons to hear.

Generally, and in operation, the device will present audio messages to relate command options and process the patron spoken utterances to carry out those commands. At any time during the telephone call, the patron may speak the word "operator" and be referred to a terminal operator. Also, at any time during the telephone call, the patron may speak the word "help" and receive context sensitive audio messages relating to how to proceed with the conversation. The patron selects from an audio menu to place a bet, review previous bets, or review racing information. To place a bet, the patron speaks "place a bet". The patron then speaks each wager component as prompt by the device. Alternatively, the patron elects to speak the entire bet in a natural language utterance. The patron speech is converted to a bet command and forwarded to the tote system for validation. To review previous bets, the patron speaks "review bets" and the device provides audio messages detailing the bets made during this telephone call reciting the most recent bet first and the first bet last. To review racing information the patron says "racing information" after opening the account. The device presents an audio message asking the patron to select "Win Odds", "Previous Results", or "Scratched Runners". The patron speaks the racing information option to be processed. To hear the Win Odds for a specific race, the patron speaks the track name and race number to be queried. The win odds command is sent to the tote system and it responds by returning the win odds for each selection in the race. The device will present an audio message to the patron detailing the win odds for the requested race. To hear the results of a previous race, the patron speaks the track name and race number to be queried. The results command is sent to the tote system and it responds by returning a list of results. Each result in the list of results consists of a selection, a bet type, and a price. For example, Horse 1, Win, paid $3.60. Each result in the result list is presented to the patron as an audio message. To hear the scratched runners for a specified track, the patron speaks the track name. The scratched runner command is sent to the tote system and it responds by returning a list of scratched runners by race. For example, race 1, 3 is scratched, race 2, no scratches. The list of scratched runners by race is presented to the patron as an audio message.

As explained above, one aspect of the present invention is to enable parimutuel account wager through the use of speech recognition. No known wagering device places wagers, reviews wagers, or reviews racing information by use of speech commands.

DETAILED DESCRIPTION OF THE INVENTION

Set forth below is a detailed description of an exemplary embodiment of a wagering system. Many variations of such system are possible. For example, the present invention is not limited to being practiced in connection with the system architecture described below and many other system architectures could be utilized.

Figure 1:
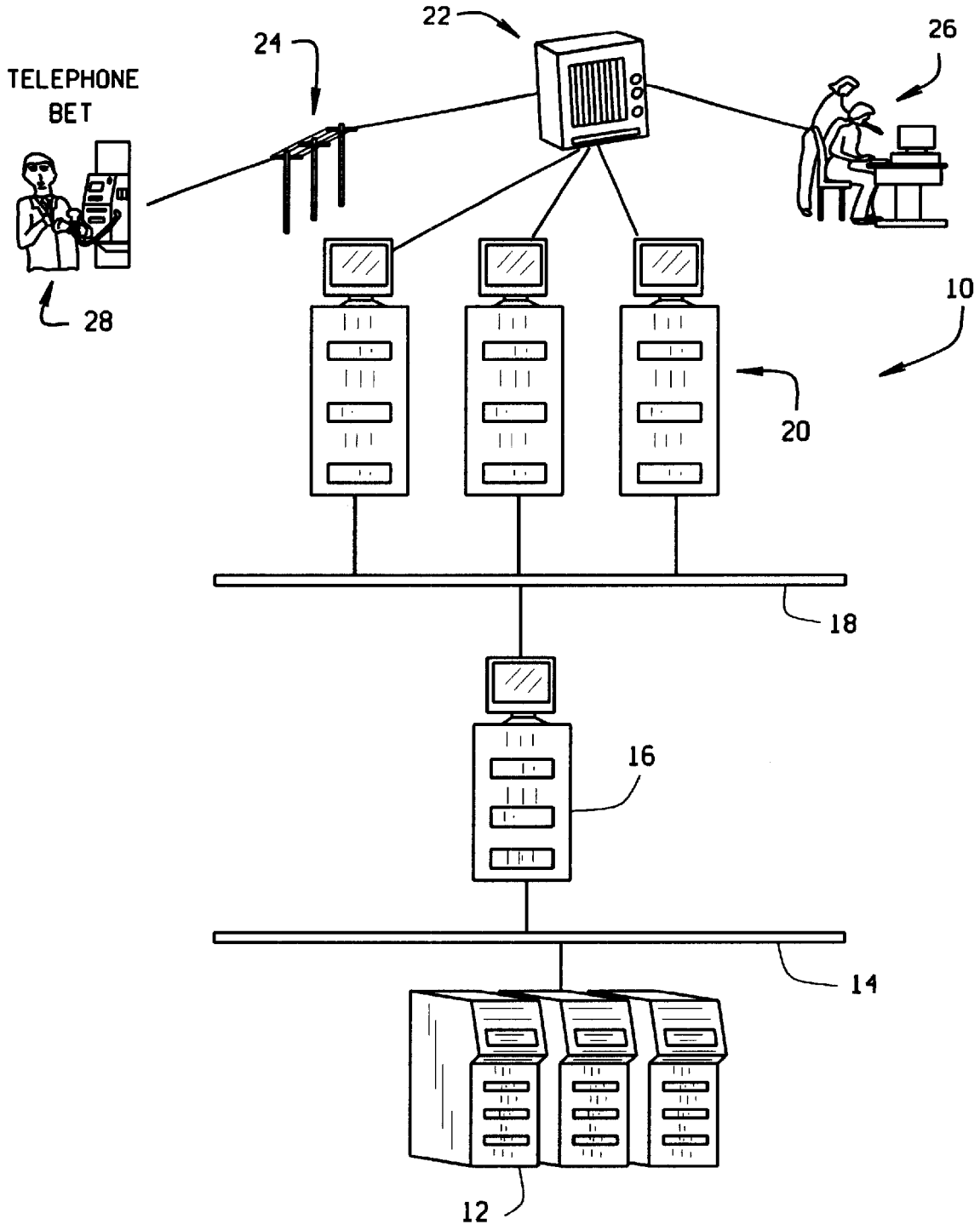
FIG. 1 is a block diagram of the wagering system.

FIG. 1 is a block diagram of a wagering system 10 which includes a tote system 12, coupled by a high speed network 14, for example, a "100BaseT Eitherner" network to a gateway 16. A separate high speed network 18, for example, a "100BaseT Eithernet" network couples a plurality of voice recognition units 20 and gateway 16. Voice recognition units 20, are connected to a local telephone switch 22 by a high speed telecommunication circuit, for example, a "T1 connection." Local telephone switch 22 is connected to a public switching telephone network (PSTN) 24 by a plurality of high speed telecommunication circuits, for example, "T1 connections." Local telephone switch 22 is also connected to a plurality of terminal operators 26, using individual telephone circuits and telephones. PSTN 24, allows a plurality of individual telephone account bettors 28, to connect to the local telephone switch 22, using public telephone circuits.

Tote system 12, gateway 16, and voice recognition units 20, for example, may be business file server computers commercially available from Compaq Computer Corporation, Houston, Tex. 77269-2000. Local telephone switch 22, for example, may be a telephone switch commercially available from Rolm, A Siemens Company, 4900 Old Ironsides Drive, Santa Clara, Calif. 95052-8075. Voice recognition units 20 include commercially available telephonic interface devices available, for example, from Dialogic Corporation, 1515 Route 10, Parsippany, N.J. 07054-4596. Voice recognition units 20 also contain software to perform speech recognition. Such software is commercially available, for example, from Speech Works International, 695 Atlantic Avenue, Boston, Mass. 02111.

Tote system 12 manages wagering system 10. Specifically, tote system 12 maintains databases, controls and accounts for the transactions with gateway 16, manages the wagers by collating pools from all sources and computing winnings, manages the wagering accounts by accounting for all debits and credits by account, and provides detailed statistics for the disbursement of funds.

Tote system 12 includes multiple databases including a wager profile and control database, a liability database, an account bettor database, and a network profile and control database. With respect to the wager profile and control database, such database contains data relating to which wagers are currently in use and the status of the wager. The hierarchy of wager definitions is as follows:

Wager Type

Wager Rules Table

Wager Definition

Wager Group

Wager type defines a kind of wager, including such attributes as the number of selections in a bet, the number of winning positions to consider, and the method of matching winning positions to bet selections.

Wager rules table contain data relating to variations in the rules for a basic wager type which the operator may alter. These options include, for example, the percentages of sales which are allotted to the tiers of major and minor progressive pools and to commissions (take-outs), denomination of a basic wager and minimum payment levels.

In the wager definition database, data is stored to define each instance of a wager type upon which wagers can be placed. Attributes include, for example, wager type, wager rule table selections, current status such as "betting open", "open time", and "final close time", and amounts in the bet pool.

The wager group database defines a set of races at a specific race track or set of race tracks in which a collection of wager types may be offered. Telephone bettors 28, using PSTN 24, local telephone switch 22, voice recognition unit 20, and gateway 16, are allowed to wager on wager groups defined in this database. There may be a network of regional tote systems 12 collating pools into one master system, for example, a host tote system 12.

The liability database contains several tables for the reporting of financial liabilities. These tables include commissions, cooperating industry entitlements, account payments, breakage, and minimum payments.

Commissions: taxes and other fixed percentage of sales which are removed before determination of the pari-mutuel pool.

Cooperating industry entitlements: distributions to the racing industry or other such interest groups, such as race tracks, horse/dog owners, jockey's and horseman's groups.

Account payments: total amounts paid to winning patron's accounts and a history of such payments.

Breakage: if any of the price round-off is not distributed, the amounts, including separation of the regulated round-off and any higher actual round-off.

Minimum payments: if any minimum payments levels have been used, the amounts, including separation of the regulated minimum and any higher actual payments.

The account bettor database, stores data unique to each patron that has established a wagering account with the race track operator. The database contain patron information such as name, address, and social security number. The database is organized by account numbers assigned to individual patrons. Each patron is also assigned a personal identification number (PIN) to secure the account. The account bettor database also stores the account balance, all wager transaction history, and all deposit and withdrawal transaction history.

The network profile and control database contains tables which define the communications network. The network is a hierarchy of nodes, which is set forth below.

Gateway

Voice recognition unit

Gateway 16, contains intermediate nodes for line multiplexing and protocol conversion. Voice recognition unit 20, connected to gateway 16 is a set of terminal nodes. Configuration of the nodes is under direct control of the system operator. Each voice recognition unit 20, includes 24 terminal nodes to gateway 16, and tote system 12.

Gateway 16 also includes a database of personal information by account number. Personal information includes the prompt level, most frequent track, most frequent bet type, and number of times the patron has logged on. Personal information is used by the speech recognition engine to favor tracks and bet types often wagered by a patron.

Figure 2:
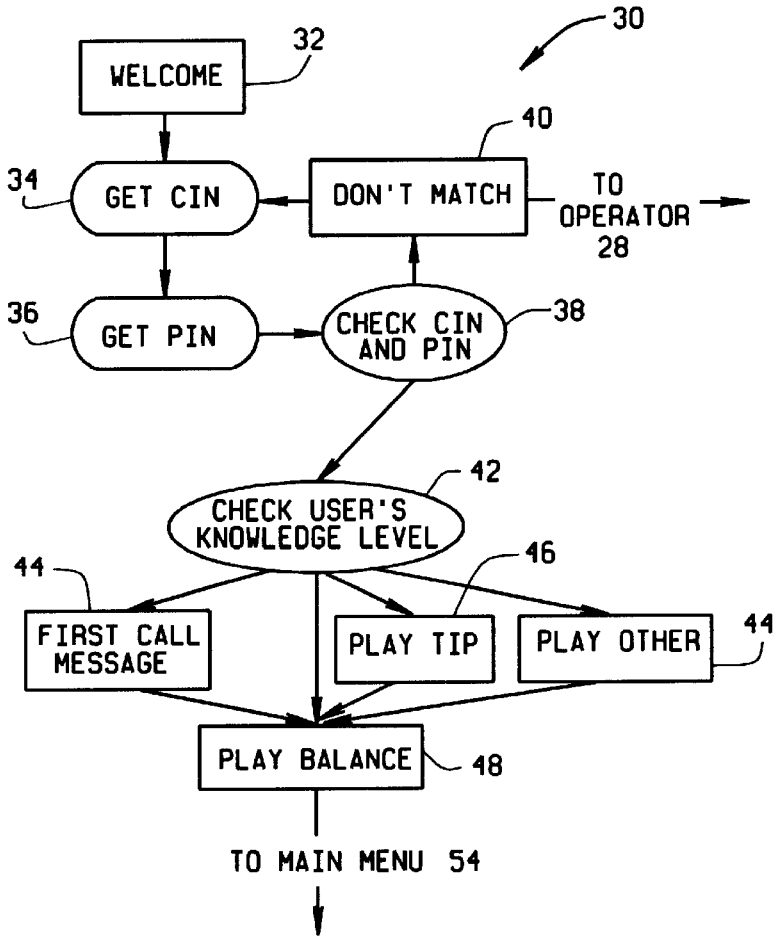
FIG. 2 is a flow chart of the log in process.

FIG. 2 is a flow chart describing a log on process 30. Voice recognition unit 20 welcomes 32 a patron by answering the telephone and greeting the patron. Voice recognition unit 20 obtains 34 account identification number (CIN) and obtains 36 personal identification number (PIN), by prompting the patron for a CIN and a PIN respectively. The patron speaks the CIN and the PIN associated with the account to open the account for wagering activity. Voice recognition unit 20 checks 38 the CIN and PIN by transmitting the account number and PIN to wager system 20, via gateway 16, for validation. If the CIN and PIN do not match 40 a valid account, the patron is again prompted for the CIN and PIN. If after a predetermined number of times that the CIN and PIN offered by the patron do not match 40 a valid account, voice recognition unit 20 transfers the telephone call to an operator 26. If the CIN and PIN are from the same account and valid, the patron is logged onto the system and the patron's knowledge level is checked 42. If the patron is calling for the first time, a first call message is played 44. Based on the patron's knowledge level (stored in the personal database), a system usage tip may be played 46 or some other system message may be played 48. The account balance is transmitted to voice recognition unit 20, and announced 50 via audio message to the patron. The patron is then passed to a main menu process 52.

Figure 3:
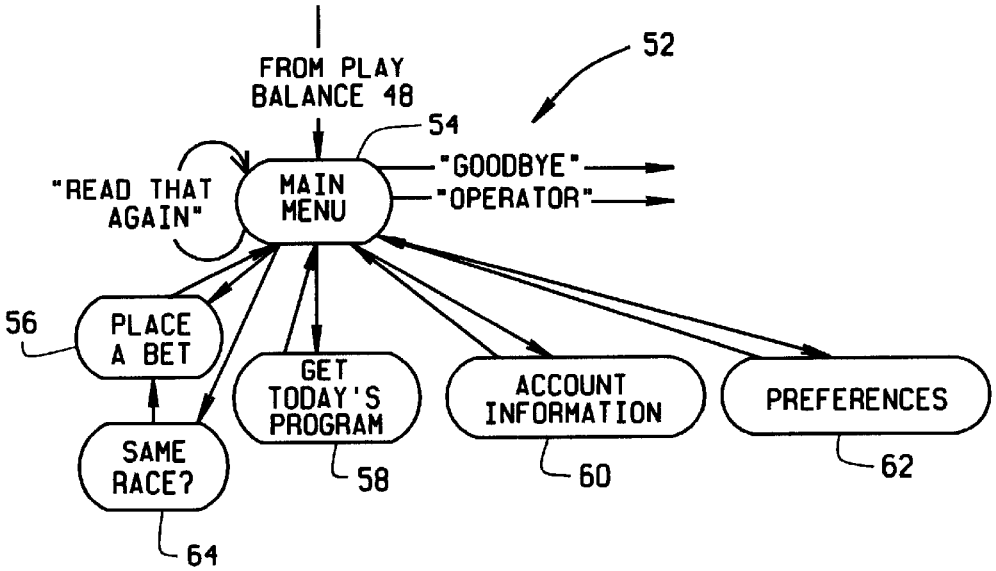
FIG. 3 is a flow chart of the main menu process.

FIG. 3 is a flowchart of main menu process 52. Main menu 54 includes place a bet 56, get today's program 58, account information 60, and preferences 62 sub-menus. After the patron has successfully logged into the system, voice recognition unit 20, plays the prompts for main menu 54. The patron speaks "Place a bet", "Get today's program", "Account information", or "Preferences". Upon recognition of one of these phrases, voice recognition unit 20, advances the call flow to the appropriate sub-menu, 56, 58, 60, and 62. If the patron speaks "read again", voice recognition unit 20 repeats the prompts for main menu 54. A patron logs off system 10 anytime by speaking "goodbye". Also, a patron is connected to operator 26 for help anytime by speaking "operator". Additionally, if the patron has placed a bet during the current call, voice recognition unit 20 asks if the patron wants to place a bet for the same race and track 64 as the last bet placed in the current call. If the patron replies no, place a bet 56 prompts the patron for the track. If the patron replies yes, the patron is passed to the place a wagering process 66.

Figure 4:
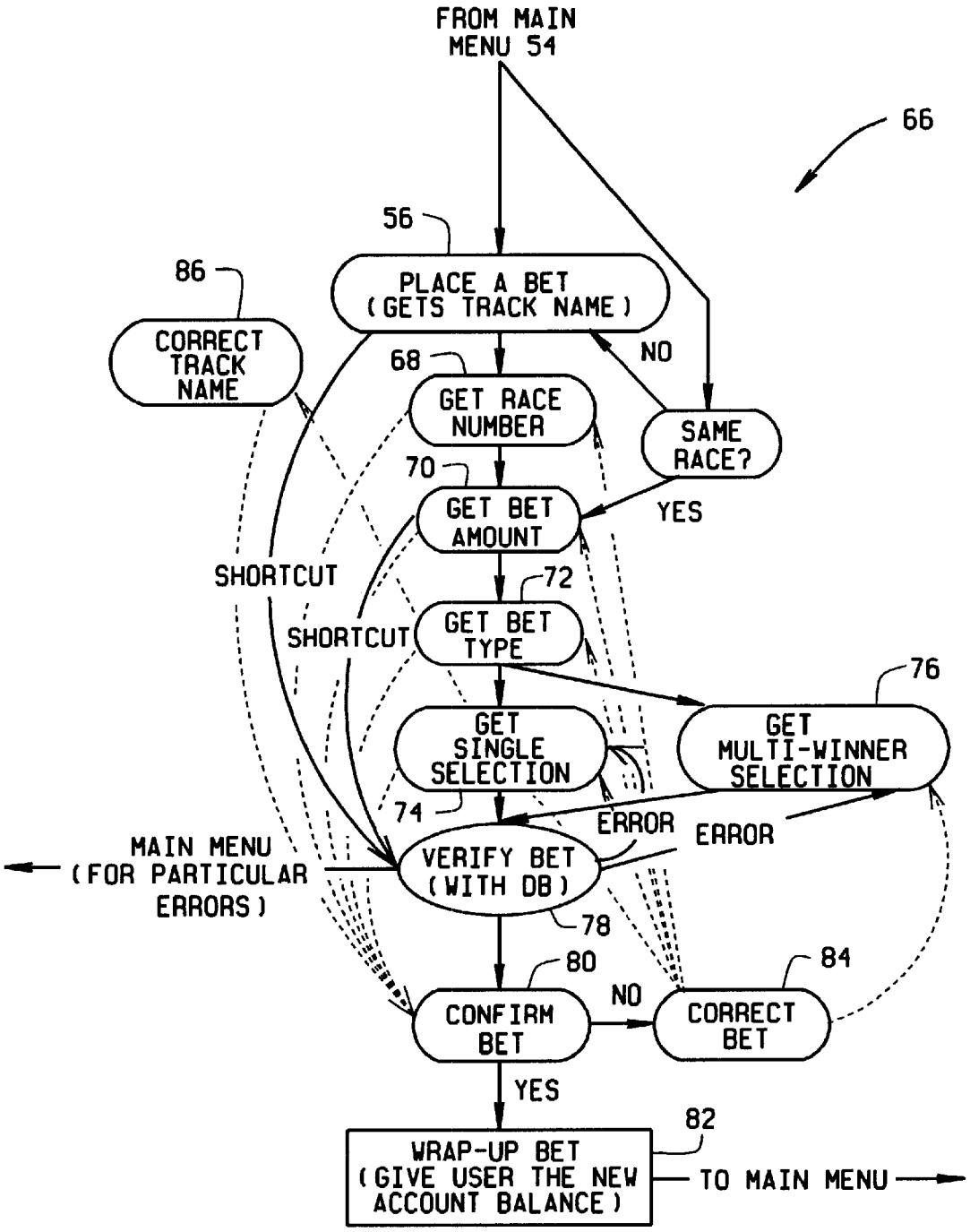
FIG. 4 is a flow chart of the wagering process.

FIG. 4 is a flow chart of wagering process 66. The patron places a bet through voice recognition unit 20. A natural language short cut allows the patron to speak all of the wager components in a single sentence. For example, "USA Downs, race two, five dollars to win on the six." Once all of the wager components have been recognized by voice recognition unit 20, the track and race wager components may be reused to place additional wagers on the same track and race. If voice recognition unit 20 fails to recognize a wager component, voice recognition unit 20 prompts for individual wager components using directed dialog. Failing to recognize a spoken wager component, voice recognition unit 20 prompts the patron to use the touch tone keys of the telephone to enter the wager component. The completely recognized wager is played back to the patron for verification. Upon receiving an affirmative confirmation, voice recognition unit 20 transmits the wager to tote system 12, via gateway 16, for validation. The valid wager is registered in tote system 12. The patron's account balance is debited by the cost of the wager. The new account balance is then announced to the patron.

Particularly, place a bet 56 prompts the patron for a track name, get race number 68 prompts the patron for the number of the race, and get bet amount 70 prompts the patron for the amount of the bet. If in menu process 52, the patron has responded positively to want to place a bet for the same race and track 64, the patron is directed to get bet amount 70. Get 72 bet type prompts the patron for the type of bet and if the bet requires a single winner selection, get 74 single winner selection prompts the patron for the winner selection. If the bet type requires multiple selections, get 76 multi-winner selections prompts the patron for the selections. Wagering process 66 then verifies 78 the bet by repeating the elements of the bet to the patron for verification. The patron then responds to confirm the bet 80. If the patron confirms the bet, the bet is wrapped-up 82 by debiting the patron's account balance by the cost of the wager and announcing the new account balance to the patron. The call is then transferred to main menu 54. If the patron does not confirm the bet, correct 84 bet prompts for the element that is not correct and transfers the patron to the corresponding prompt, correct 86 track name, get 68 race number, get 70 bet amount, get 72 bet type, get 74 single winner selection, or get 76 multi-winner selections. The patron then proceeds through wagering process 66 until the bet is confirmed and wrapped-up, and then the patron is transferred to main menu 54.

Figure 5:
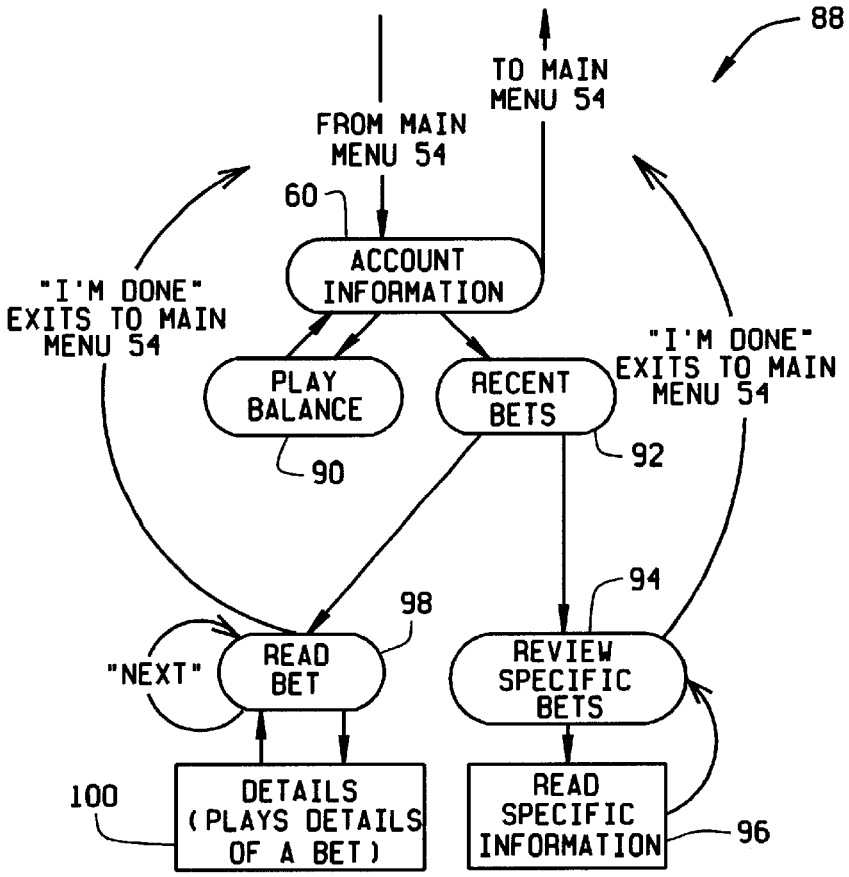
FIG. 5 is a flow chart of the account information process.

FIG. 5 is a flow chart of an account information process 88. When the patron selects get 60 account information, the patron is prompted for a selection between get 90 balance and recent bets 92. Upon recognizing the "get balance" speech phrase, voice recognition unit 20 transmits a request to tote system 12, via gateway 16, to update the account balance by adding any unposted winning wagers. Tote system 12 responds, via gateway 16, to voice recognition unit 20, and voice recognition unit 20 utters the new account balance.

If recent bets 92 is chosen, the patron is prompted to review 94 bets or read 96 bet. If the patron asks for specific bets 94, voice recognition unit 20 plays prompts to collect the specific track and race to be reviewed. The request to review wagers is transmitted from voice recognition unit 20, via gateway 16, to tote system 12. Tote system 12 responds to voice recognition unit 20, via gateway 16, with the details of the next wager (in the account bettor database) matching the request criteria. Voice recognition unit 20 speaks the wager details and prompts for whether or not to request another wager. If read 98 bets is chosen, voice recognition unit 20 provides the patron with information for all wagers made that day.

Figure 6:
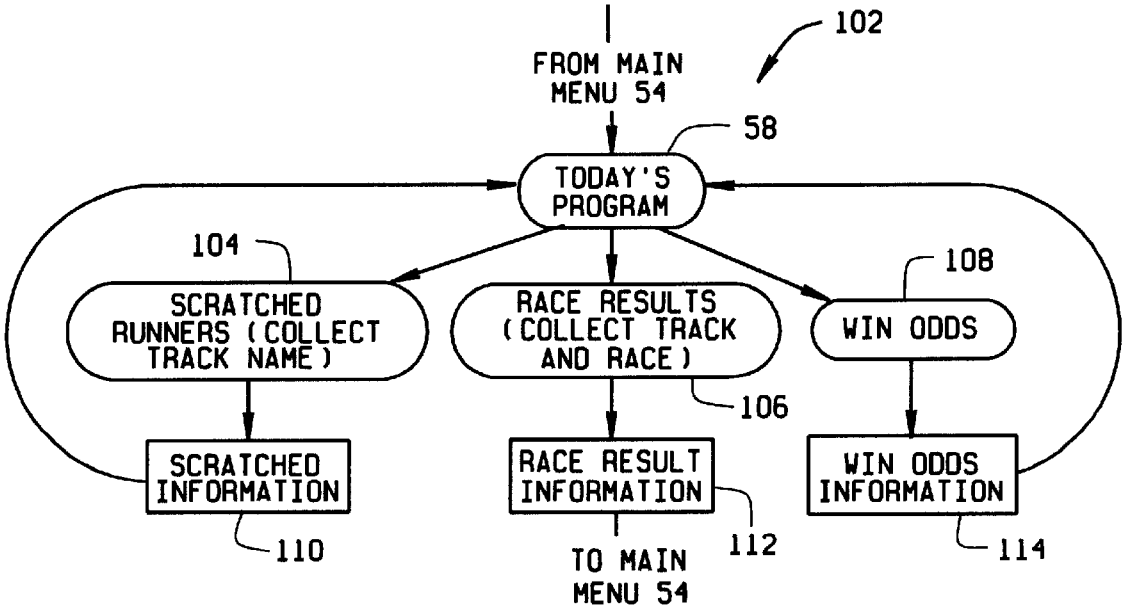
FIG. 6 is a flow chart of the racing information process.

FIG. 6 is a flow chart of a racing information process 102. During the course of placing wagers, the patron may request information to assist making wagers or to ascertain the value of a winning wager. After the patron has asked for "get racing information", a sub-menu of options is announced by voice recognition unit 20. The sub-menu prompts for scratched runners 104, race results 106 or win odds 108. In each sub-menu choice, voice recognition unit 20 subsequently prompts for the track name and race number. Voice recognition unit 20 transmits the request via gateway 16 to tote system 12. Tote system 12 transmits a response back to voice recognition unit 20 via gateway 16, and voice recognition unit 20 announces scratched information 110, race results information 112, or win odds information 114.

Figure 7:
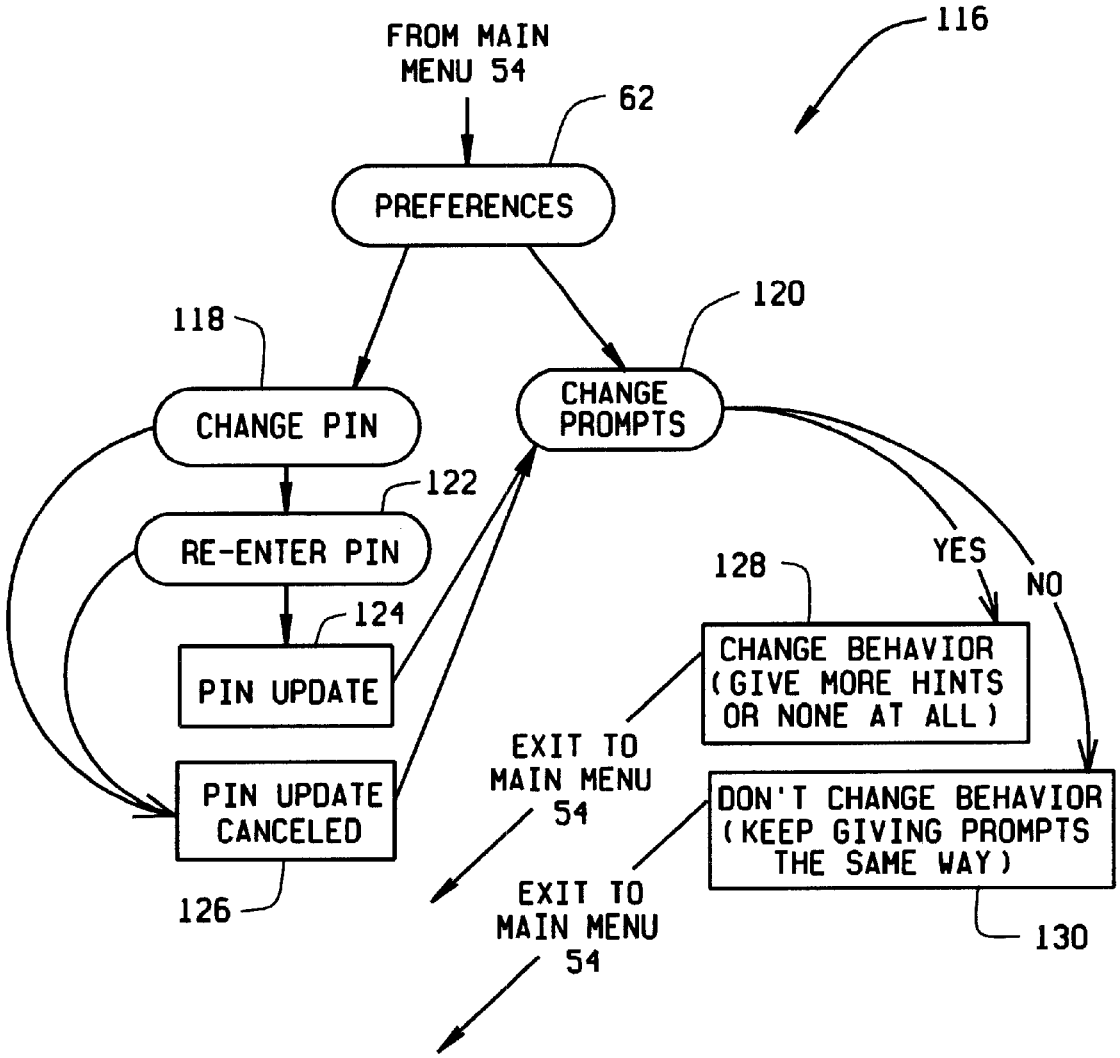
FIG. 7 is a flow chart of the preferences process.

FIG. 7 is a flow chart of a p references process 116. Having recognized the speech phrase preferences 62, voice recognition unit 20 announces a sub-menu to the patron. The sub-menu options are change PIN 118 and change prompts 120. Using change PIN 118, the patron is prompted to speak the current PIN 122 and the new PIN 124. Voice recognition unit 20 transmits to tote system 12, via gateway 16, a request to change the account PIN. Tote system 12 responds by transmitting to voice recognition 20, via gateway 16, an acknowledgment of the PIN change. If the patron does not want to change the PIN, PIN update canceled 126 transfers the patron to change prompts 120.

If change prompts 120 is chosen, voice recognition unit 20 changes behavior 128 by changing the personal information database from verbose prompts to short prompts or from short prompts to verbose prompts. If the patron chooses not to change the prompts, don't change behavior 130 is chosen which does not change the prompts and transfers the patron to main menu 54.

The above described gaming system 10 can be utilized in connection with many different types of gaming events such as horse races, dog races, jai alai games. In addition, system 10 can be utilized in connection with other types of events. Importantly, system 10 supports and rewards the racing industry by reducing operational costs.

While the invention has been described in terms of various specific embodiments, those skilled in the art will recognize that the invention can be practiced with modification within the spirit and scope of the claims.

What is claimed is:

1. A system for parimutuel gaming comprising:

a tote system;

a gateway; and at least one voice recognition unit communicatably connected to a public telephone network, each said voice recognition unit communicatably coupled to said tote system through said gateway, each said voice recognition unit configured to receive wagers from a bettor by bettor speech utterances, to convert the bettor speech utterances into commands, and to transmit said commands to said tote system through said gateway.

2. A system in accordance with claim 1 wherein each said voice recognition unit is configured to receive responses from said tote system to said commands, convert said responses to audio messages, and transmit said audio messages to the bettor.

3. A system in accordance with claim 1 further comprising:

a first high speed network communicatably connecting said tote system and said gateway; and a second high speed network communicatably connecting said gateway and each said voice recognition unit.

4. A system in accordance with claim 1 wherein said tote system comprises a computer.

5. A system in accordance with claim 4 wherein said tote system computer comprises a plurality of databases, said tote system computer configured to maintain said plurality of databases.

6. A system in accordance with claim 5 wherein said tote system computer is configured to:

control and account for transactions with said gateway;

collate wager pools;

compute winnings;

account for all debits and credits for each wager account; and provide statistics about disbursements of funds.

7. A system in accordance with claim 5 wherein said plurality of tote system databases comprises a wager profile and control database, a liability database, an account bettor database, and a network profile and control database.

8. A system in accordance with claim 7 wherein said wager profile and control database comprises:

data defining wager attributes indicative of a number of selections in a wager, a number of winning positions to consider, and methods of matching winning positions to wager selections;

data relating to variations in rules wager type indicative of percentage of sales allocated to tiers of major and minor progressive pools, commissions, amount of a basic wager, and minimum payout levels; and data defining each wager type indicative of each instance of a wager type upon which wagers can be placed, wager rule selection, wagering status, and amounts in said major and minor progressive wager pools, and data defining a set of races at a race track or at a set of race tracks.

9. A system in accordance with claim 7 wherein said liability database comprises:

data indicative of commissions and taxes to be removed from wager pools before determination of the parimutuel wager pool allotment;

data indicative of distributions to the racing industry or other related interest groups;

data indicative of an amount of payments to each winning player and a history of said payments;

data indicative of price round-off not returned to said wager pools; and data indicative of minimum payout levels.

10. A system in accordance with claim 7 wherein said account bettor database comprises:

data indicative of each bettor;

data indicative of a personal identification number for each bettor;

data indicative of an account balance for each bettor;

data indicative of a wager transaction history of each bettor; and data indicative of a deposit and withdrawal history of each bettor.

11. A system in accordance with claim 7 wherein said network profile and control database comprises data indicative of a communication network.

12. A system in accordance with claim 11 wherein said communication network comprises a hierarchy of nodes, said hierarchy of nodes comprise said gateway and said at least one voice recognition unit.

13. A system in accordance with claim 1 wherein said gateway comprises a computer.

14. A system in accordance with claim 13 wherein said gateway computer comprises a plurality of intermediate nodes and at least one database.

15. A system in accordance with claim 14 wherein said at least one database comprises a personal information database.

16. A system in accordance with claim 15 wherein said personal information database comprises:

data indicative of bettors'preferences including a most frequent track and a most frequent wager type;

data indicative of a number of times each bettor has logged on to said system; and data indicative of a prompt level for each bettor.

17. A system in accordance with claim 14 wherein said plurality of intermediate nodes are configured for line multiplexing and protocol conversion.

18. A system in accordance with claim 1 wherein each voice recognition unit comprises a computer.

19. A system in accordance with claim 18 wherein said voice recognition computer is configured to manage a telephone conversation with a bettor.

20. A system in accordance with claim 19 wherein said voice recognition computer is configured to:

answer the telephone call from a bettor;

greet bettor with a first audio message;

prompt bettor for choice of available options with a second audio message;

listen to bettor speech utterances and convert the speech utterances into system commands;

transmit said commands to said tote system through said gateway;

receive responses to said commands transmitted from said tote system through said gateway; and convert responses to a third audio message for transmitting to the bettor.

21. A system in accordance with claim 20 wherein said system is configured to:

answer a call and log a bettor onto said system;

provide a plurality of menu choices to the bettor by an audio message;

receive a menu choice from bettor by receiving bettor speech utterances and converting the bettor speech utterances to a system command; and process said system command and return an audio message corresponding to said processed command.

22. A system in accordance with claim 21 wherein said system is further configured to repeat receiving bettor speech utterances indicative of bettor menu choices, converting the speech utterances to system commands, processing the commands, and returning audio messages corresponding to said processed commands until the bettor logs off said system.

23. A system in accordance with claim 22 wherein the plurality of menu choices include place a bet, review today's program, review account information, and bettor preferences.

24. A system in accordance with claim 23 wherein said system is further configured to:

ask for an account number and a personal identification number with an audio message;

receive bettor speech utterances corresponding to the account number and personal identification number;

check to validate the account number and the personal identification number;

if the account number and personal identification number are not valid, said system is further configured to ask bettor again for an account number and a personal identification number; and if the account number and personal identification number are valid, said system is further configured to log the bettor into the system and provide a plurality of menu choices to the bettor by an audio message.

25. A system in accordance with claim 24 wherein said system is further configured to:

ask for a race track name, race number, amount of bet, and bet type;

if the bet type is a single winner selection type bet, said system is further configured to ask for a winner selection;

if the bet type is a multi-winner selection type bet, said system is further configured to ask for winner selections;

confirm bet;

if the bet is not correct, said system is further configured to correct the bet by asking bettor for race track name, race number, amount of bet, bet type, and winner selection or selections; and if bet is correct, said system is configured to enter bet and inform bettor of an adjusted account balance with an audio message.

26. A system in accordance with claim 24 wherein said system is further configured to:

inform bettor of the account balance with an audio message; and inform bettor of recent bets with audio messages.

27. A system in accordance with claim 24 wherein said system is further configured to:

inform bettor of scratched race entries from specific tracks with audio messages;

inform bettor of race results from specific tracks with audio messages; and inform bettor of win odds with audio messages.

28. A system in accordance with claim 24 wherein said system is further configured to:

prompt for changes to personal identification number and for changes in system behavior with audio messages;

receive bettor speech utterances indicative of personal information number and changes in system behavior; and update personal identification number and system behavior.

29. A system in accordance with claim 1 further comprising a local telephone switch communicatably connecting said at least one voice recognition unit to a public switching telephone network.

30. A method of parimutuel wagering utilizing a parimutuel gaming system with bettor speech recognition, the gaming system comprising a tote system, a gateway, and at least one voice recognition unit, each voice recognition unit communicatably connected to a public telephone network, and communicatably coupled to the tote system through the gateway, each voice recognition unit configured to receive wagers from a bettor by bettor speech utterances, to convert the bettor speech utterances into commands, to transmit the commands to the tote system through the gateway, to receive responses from the tote system to the commands, to convert the responses to audio messages, and to transmit the audio messages to the bettor, said method comprising the steps of:

answering a call;

logging a bettor onto the gaming system;

providing a plurality of menu choices to the bettor by an audio message;

receiving menu choices from the bettor by receiving bettor speech utterances;

converting the bettor speech utterances to system commands;

processing the system commands; and transmitting an audio message to the bettor corresponding to the processed commands.

31. A method in accordance with claim 30 wherein utilizing a parimutuel gaming system comprises the step of utilizing a parimutuel gaming system wherein said system further comprises:

a first high speed network communicatably connecting the tote system and the gateway; and a second high speed network communicatably connecting the gateway and each voice recognition unit.

32. A method in accordance with claim 30 wherein utilizing a parimutuel gaming system comprises the step of utilizing a parimutuel gaming system wherein the tote system comprises a computer.

33. A method in accordance with claim 32 wherein utilizing a parimutuel gaming system comprises the step of utilizing a parimutuel gaming system wherein the tote system computer comprises a plurality of databases, the tote system computer configured to maintain the plurality of databases.

34. A method in accordance with claim 33 wherein utilizing a parimutuel gaming system comprises the step of utilizing a parimutuel gaming system wherein the tote system computer is configured to:

control and account for transactions with the gateway;

collate wager pools;

compute winnings;

account for all debits and credits for each wager account; and provide statistics about disbursements of funds.

35. A method in accordance with claim 33 wherein utilizing a parimutuel gaming system comprises the step of utilizing a parimutuel gaming system wherein the plurality of tote system databases comprises a wager profile and control database, a liability database, an account bettor database, and a network profile and control database.

36. A method in accordance with claim 35 wherein utilizing a parimutuel gaming system comprises the step of utilizing a parimutuel gaming system wherein the wager profile and control database comprises:

data defining wager attributes indicative of number of selections in a wager, number of winning positions to consider, and methods of matching winning positions to wager selections;

data relating to variations in rules wager type indicative of percentage of sales allocated to tiers of major and minor progressive pools, commissions, amount of a basic wager, and minimum payout levels; and data defining each wager type indicative of each instance of a wager type upon which wagers can be placed, wager rule selection, wagering status, and amounts in said major and minor progressive wager pools; and data defining a set of races at a race track or at a set of race tracks.

37. A method in accordance with claim 35 wherein utilizing a parimutuel gaming system comprises the step of utilizing a parimutuel gaming system wherein the liability database comprises:

data indicative of commissions and taxes to be removed from wager pools before determination of the parimutuel wager pool allotment;

data indicative of distributions to the racing industry or other related interest groups;

data indicative of amount of payments to each winning player and a history of the payments;

data indicative of price round-off not returned to the wager pools; and data indicative of minimum payout levels.

38. A method in accordance with claim 35 wherein utilizing a parimutuel gaming system comprises the step of utilizing a parimutuel gaming system wherein the account bettor database comprises:

data indicative of each bettor;

data indicative of a personal identification number for each bettor;

data indicative of an account balance for each bettor;

data indicative of a wager transaction history of each bettor; and data indicative of a deposit and withdrawal history of each bettor.

39. A method in accordance with claim 35 wherein utilizing a parimutuel gaming system comprises the step of utilizing a parimutuel gaming system wherein the network profile and control database comprises data indicative of a communication network.

40. A method in accordance with claim 39 wherein utilizing a parimutuel gaming system comprises the step of utilizing a parimutuel gaming system wherein the communication network comprises a hierarchy of nodes, the hierarchy of nodes comprise the gateway and the at least one voice recognition unit.

41. A method in accordance with claim 30 wherein utilizing a parimutuel gaming system comprises the step of utilizing a parimutuel gaming system wherein the gateway comprises a computer.

42. A method in accordance with claim 41 wherein utilizing a parimutuel gaming system comprises the step of utilizing a parimutuel gaming system wherein the gateway computer comprises a plurality of intermediate nodes and at least one database.

43. A method in accordance with claim 42 wherein utilizing a parimutuel gaming system comprises the step of utilizing a parimutuel gaming system wherein the at least one database comprises a personal information database.

44. A method in accordance with claim 43 wherein utilizing a parimutuel gaming system comprises the step of utilizing a parimutuel gaming system wherein the personal information database comprises:

data indicative of bettors'preferences including most frequent track, most frequent wager type;

data indicative of number of times each bettor has logged on to the system; and data indicative of a prompt level for each bettor.

45. A method in accordance with claim 42 wherein utilizing a parimutuel gaming system comprises the step of utilizing a parimutuel gaming system wherein the plurality of intermediate nodes are configured for line multiplexing and protocol conversion.

46. A method in accordance with claim 30 wherein utilizing a parimutuel gaming system comprises the step of utilizing a parimutuel gaming system wherein each voice recognition unit comprises a computer.

47. A method in accordance with claim 46 wherein utilizing a parimutuel gaming system comprises the step of utilizing a parimutuel gaming system wherein the voice recognition computer is configured to manage a telephone conversation with a bettor.

48. A method in accordance with claim 47 wherein utilizing a parimutuel gaming system comprises the step of utilizing a parimutuel gaming system wherein the voice recognition computer is configured to:

answer the telephone call from a bettor;

greet bettor with a first audio message;

prompt bettor for choice of available options with a second audio message;

listen to bettor speech utterances and convert the speech utterances into system commands;

transmit the commands to the tote system through the gateway;

receive responses to the commands transmitted from the tote system through the gateway; and convert the responses to a third audio message for transmitting to the bettor.

49. A method in accordance with claim 30 wherein utilizing a parimutuel gaming system comprises the step of utilizing a parimutuel gaming system further comprising a local telephone switch communicatably connecting said at least one voice recognition unit to a public switching telephone network.

50. A method in accordance with claim 30 further comprising the step of repeating, until the bettor logs off the system, the steps of:

receiving menu choices from bettor by receiving bettor speech utterances;

converting the bettor speech utterances to system commands;

processing the system commands; and transmitting an audio message to the bettor corresponding to the processed commands.

51. A method in accordance with claim 30 wherein logging a bettor onto the system comprises the steps of:

asking for an account number and a personal identification number with an audio message;

receiving bettor speech utterances corresponding to the account number and personal identification number;

checking to validate the account number and the personal identification number;

asking the bettor again for an account number and a personal identification number if the account number and personal identification number are not valid;

logging the bettor into the system if the account number and personal identification number are valid.

52. A method in accordance with claim 30 wherein providing a plurality of menu choices to the bettor by an audio message comprises the step of providing menu choices comprising place a bet, review today's program, review account information, and bettor preferences.

53. A method in accordance with claim 52 further comprising the steps of:

asking for a race track name, race number, amount of bet, and bet type;

asking for a winner selection if the bet type is a single winner selection type bet;

asking for winner selections if the bet type is a multi-winner selection type bet;

confirming the bet;

correcting the bet by asking bettor for race track name, race number, amount of bet, bet type, and winner selection or selections if the bet is not correct;

entering the bet and informing bettor of an adjusted account balance with an audio message if the bet is correct.

54. A method in accordance with claim 52 further comprising the steps of:

informing bettor of the account balance with an audio message; and informing bettor of recent bets with audio messages.

55. A system in accordance with claim 52 further comprising the steps of:

informing bettor of scratched race entries from specific tracks with audio messages;

informing bettor of race results from specific tracks with audio messages; and informing bettor of win odds with audio messages.

56. A method in accordance with claim 52 further comprising the steps of:

prompting for changes to personal identification number and for changes in system behavior with audio messages;

receiving bettor speech utterances indicative of personal information number and changes in system behavior; and updating personal identification number and system behavior.

57. A method of parimutuel wagering utilizing a parimutuel gaming system with bettor speech recognition, said method comprising the steps of:

answering a call;

logging a bettor onto the gaming system;

providing a plurality of menu choices to the bettor by an audio message;

receiving menu choices from bettor by receiving bettor speech utterances;

converting the bettor speech utterances to system commands;

processing the system commands; and transmitting an audio message to the bettor corresponding to the processed commands.

58. A method in accordance with claim 57 further comprising the step of repeating, until the bettor logs off the system, the steps of:

receiving menu choices from the bettor by receiving bettor speech utterances;

converting the bettor speech utterances to system commands;

processing the system commands; and returning an audio message corresponding to the processed commands.

59. A method in accordance with claim 57 wherein logging a bettor onto the system comprises the steps of asking for an account number and a personal identification number with an audio message;

receiving bettor speech utterances corresponding to the account number and personal identification number;

checking to validate the account number and the personal identification number;

asking the bettor again for an account number and a personal identification number if the account number and personal identification number are not valid; and logging the bettor into the system if the account number and personal identification number are valid.

60. A method in accordance with claim 57 wherein providing a plurality of menu choices to the bettor by an audio message comprises the step of providing menu choices comprising place a bet, review today's program, review account information, and bettor preferences.

61. A method in accordance with claim 60 further comprising the steps of:

asking for a race track name, race number, amount of bet, and bet type;

asking for a winner selection if the bet type is a single winner selection type bet;

asking for winner selections if the bet type is a multi-winner selection type bet;

confirming the bet;

correcting the bet by asking bettor for race track name, race number, amount of bet, bet type, and winner selection or selections if the bet is not correct;

entering the bet and informing bettor of an adjusted account balance with an audio message if the bet is correct.

62. A method in accordance with claim 60 further comprising the steps of:

informing the bettor of the account balance with an audio message; and informing the bettor of recent bets with audio messages.

63. A system in accordance with claim 60 further comprising the steps of:

informing bettor of scratched race entries from specific tracks with audio messages;

informing bettor of race results from specific tracks with audio messages; and informing bettor of win odds with audio messages.

64. A method in accordance with claim 60 wherein if the bettor chooses to review preferences, said method further comprises the steps of:

prompting for changes to personal identification number and for changes in system behavior with audio messages;

receiving bettor speech utterances indicative of personal information number and changes in system behavior; and updating personal identification number and system behavior.

* * * * *